US005509894A

United States Patent [19]

Mason et al.

[11] Patent Number: 5,509,894

[45] Date of Patent: Apr. 23, 1996

[54] LEG SUSPENSION METHOD FOR FLEXION AND EXTENSION EXERCISE OF THE KNEE OR HIP JOINT

[75] Inventors: Bradley R. Mason, Olivenhain; Jeffrey T. Mason, Escondido, both of Calif.

[73] Assignee: Breg, Inc., Vista, Calif.

[21] Appl. No.: 228,653

[22] Filed: Apr. 18, 1994

Related U.S. Application Data

[63] Continuation-in-part of Ser. No. 974,980, Nov. 12, 1992, Pat. No. 5,303,716.

[51] Int. Cl.[6] ..... A61H 1/00

[52] U.S. Cl. ..... 601/34; 602/35; 606/241

[58] Field of Search ..... 601/33–35; 602/32–35; 606/241; 482/907, 900, 904; 128/845

[56] References Cited

U.S. PATENT DOCUMENTS

| | | | |
|---|---|---|---|
| 3,153,411 | 10/1964 | Unks | 602/33 |
| 3,612,042 | 10/1971 | Fry | 601/34 |
| 3,612,047 | 10/1971 | Fry | 128/25 R |
| 4,362,151 | 12/1982 | Cottrell | 606/241 |
| 4,489,713 | 12/1984 | Latenser | 5/624 |
| 4,492,222 | 1/1985 | Hajianpour . | |
| 4,546,763 | 10/1985 | Coutts . | |
| 4,602,618 | 7/1986 | Berzé | 482/904 |
| 4,621,625 | 11/1986 | Powlan | 602/33 |
| 4,674,485 | 6/1987 | Swanson | 602/33 |
| 4,715,361 | 12/1987 | Mauldin et al. . | |
| 4,825,852 | 5/1989 | Genovese et al. . | |
| 4,834,073 | 5/1989 | Bledsoe et al. . | |
| 4,844,454 | 7/1989 | Rogers | 601/34 |
| 4,922,892 | 5/1990 | Akcelrod et al. | 601/34 |
| 4,974,830 | 12/1990 | Genovese et al. . | |
| 5,048,825 | 9/1991 | Kelly | 482/904 |
| 5,076,576 | 12/1991 | Johnston . | |
| 5,254,060 | 10/1993 | Bohanan | 601/33 |
| 5,290,219 | 3/1994 | Hetrick | 602/32 |

FOREIGN PATENT DOCUMENTS

| | | | |
|---|---|---|---|
| 1366214 | 5/1963 | France . | |
| 2468359 | 5/1981 | France . | |
| 310256 | 1/1919 | Germany | 602/33 |
| 1540824 | 2/1990 | U.S.S.R. | 128/25 B |
| 2201353 | 9/1988 | United Kingdom . | |

*Primary Examiner*—Richard J. Apley
*Assistant Examiner*—Jeanne M. Clark
*Attorney, Agent, or Firm*—Rodney F. Brown

[57] ABSTRACT

A leg suspension device is provided enabling rehabilitative exercise of the leg, and specifically enabling passive or active range of motion exercise of the knee or hip joint. The leg suspension device includes a bar having proximal and distal segments, and a fulcrum rotatably engaging the bar between the proximal and distal segments to permit rotation of the bar about the fulcrum in a vertical plane. Upper and lower leg cuffs are connected to the proximal and distal segments, respectively, suspending the upper and lower legs while isolating the knee joint. A base is provided to free-standingly support the device during use, or, alternatively, the device is adapted for affixing to an overhead anchor. For passive motion exercise, the thigh and ankle are suspended from the cuffs and the user drives rotation of the bar solely with the upper body muscles about the fulcrum in alternate opposing directions, causing alternate passive flexion and extension of the knee and hip joint. The same procedure is repeated for assisted active motion exercise, but the user drives rotation of the bar about the fulcrum with the upper body and leg muscles simultaneously. For independent active motion exercise, the user drives rotation of the bar about the fulcrum entirely with the leg muscles.

3 Claims, 4 Drawing Sheets

LEG SUSPENSION METHOD FOR FLEXION AND EXTENSION EXERCISE OF THE KNEE OR HIP JOINT

This patent application is a continuation-in-part patent application of patent application Ser. No. 07/974,980, filed on Nov. 12, 1992 and issued as U.S. Pat. No. 5,303,716, on Apr. 19, 1994.

TECHNICAL FIELD

The present invention relates to a device for rehabilitative exercise of the leg and more particularly to a device enabling passive or active flexion and extension exercise of the knee or hip joint.

BACKGROUND OF THE INVENTION

Immediate post-operative rehabilitation of the knee or hip joint is desirable following many surgical procedures, including total joint replacement or joint reconstruction, to restore the joint to its full range of motion. Effective rehabilitation requires controlled movement of the knee or hip joint as soon as possible after surgery without bearing weight on the joint or placing a substantial force load on the joint. As rehabilitation progresses, the range of joint movement can be increased and force loads can be applied to the joint.

U.S. Pat. No. 3,612,042 to Fry discloses a manually driven device for exercising a hip joint of a bedridden patient. The device has an overhead support structure positioned above the bed of a reclining patient. A rigid bar is mounted to the support structure by a swivel assembly engaging the midpoint of the bar above the affected hip joint. The swivel assembly is configured to permit rotation of the bar in a horizontal plane, but not in a vertical plane. A pair of slings hang from the distal end of the bar above the leg and a handle is provided at the proximal end of the bar for manual operation of the device. In operation, the fully-extended leg is placed in the slings and suspended from the distal end of the bar. The proximal end of the bar is manually rotated in a horizontal plane toward the longitudinal axis of the patient's body, thereby rotating the distal end away from the longitudinal axis. Horizontal rotation of the bar in this manner increases the abduction angle of the leg to provide abduction exercise of the hip joint.

Although the device of Fry provides effective abduction exercise of the hip joint, it has no utility for flexion and extension exercise of the hip or knee joint. Other devices have been developed for flexion and extension exercise of the knee joint termed continuous passive motion devices. Such devices, as for example disclosed in U.S. Pat. No. 4,974,830 to Genovese et al., mount the leg on a support structure while the knee joint is driven through alternating flexion and extension by applying a motorized external force to the knee joint across a mechanical pivot point. Continuous passive motion devices require careful anatomical alignment of the support structure with the leg and strict monitoring of the motorized external force loads applied to the leg joints to prevent post-operative injury to the joint during rehabilitation thereof. Furthermore, such devices are relatively complex and cumbersome to operate and maintain, as well as costly to produce.

As such, it is an object of the present invention to provide a device for rehabilitation of a leg joint, and in particular a knee or hip joint, which is relatively inexpensive to produce, and relatively simple to operate and maintain. It is another object of the present invention to provide a device for rehabilitation of the knee or hip joint which is readily adaptable to different size users without requiring careful anatomical alignment of the device with the knee joint. It is a further object of the present invention to provide a device that can passively apply a controlled manual force to the knee or hip joint for range of motion exercise thereof with a relatively low risk of injury to the joint. It is another object of the present invention to provide a device that can actively apply a desired degree of the user's own leg muscle force to the knee or hip joint for range of motion exercise of the joint without bearing weight thereon.

SUMMARY OF THE INVENTION

The present invention is a leg suspension device for rehabilitative range of motion exercise of a leg joint, specifically the knee or hip joint, in accordance with the objectives set forth above. The leg suspension device is configured to permit three dynamic modes of knee or hip exercise, i.e., passive motion, assisted active motion, and independent active motion. The leg suspension device comprises a rotation bar, a fulcrum, an upper leg cuff and a lower leg cuff.

The rotation bar is substantially rigid and has a proximal segment and a distal segment that are defined in relation to the upper body of the user. The rotation bar rotatably engages the fulcrum between the proximal and distal segments enabling rotation of the bar in a substantially vertical plane about the fulcrum. The upper and lower leg cuffs are rotatably connected to the proximal and distal segments of the rotation bar, respectively. Connection of the upper and lower leg cuffs to the proximal and distal segments is provided by directly attaching the cuffs to the rotation bar or, alternatively, by indirectly attaching the cuffs to the rotation bar by means of flexible extension members extending from each cuff to the rotation bar.

The leg suspension device further comprises means to which the fulcrum is mounted for elevating the fulcrum to an operative position above a substantially horizontal support surface upon which the user reclines to perform the desired leg exercises. In one embodiment, the fulcrum elevating means is a portable base having a plurality of legs adapted to stand upright on the support surface and free-standingly support the fulcrum above the support surface. In an alternate embodiment, the fulcrum elevating means is a substantially fixed overhead anchor, such as an elevated frame extending over a bed, to which the fulcrum is releasably attached.

To operate the leg suspension device, the lower leg is placed within the lower leg cuff such that the lower leg cuff retains the lower leg about the ankle. The upper leg is similarly placed within the upper leg cuff such that the upper leg cuff retains the upper leg about the thigh. With the upper and lower legs retained within the upper and lower leg cuffs, the knee joint is suspended in balanced isolation between the cuffs. Accordingly, the cuffs are organically connected to one another across the user's knee joint, enabling the freely-rotatable cuffs to intrinsically align with the anatomical structure of the leg without requiring strict adjustment of cuff alignment.

For the passive motion mode of exercise, the user grips the proximal end of the rotation bar with a hand. Applying the user's own upper body muscles, the user alternately raises and lowers the proximal end of the rotation bar, thereby causing the rotation bar to pivot about the fulcrum.

The upper and lower leg cuffs rotatably displace in correspondence with the pivotal displacement of the rotation bar to achieve alternate passive flexion and extension exercise of the knee and hip joints through the desired range of motion. The same procedure is repeated for the assisted active motion mode of exercise, but the user partially drives pivotal displacement of the rotation bar with the leg muscles, augmenting the manual drive applied by the upper body muscles to exercise the knee or hip joint through the desired range of motion. For the independent active motion mode of exercise, the user releases the grip on the rotation bar entirely and drives pivotal displacement of the rotation bar solely with the user's leg muscles, thereby exercising the knee or hip joint.

The invention will be further understood, both as to its structure and operation, from the accompanying drawings, taken in conjunction with the accompanying description, in which similar reference characters refer to similar parts.

DESCRIPTION OF PREFERRED EMBODIMENTS

Figure 1:
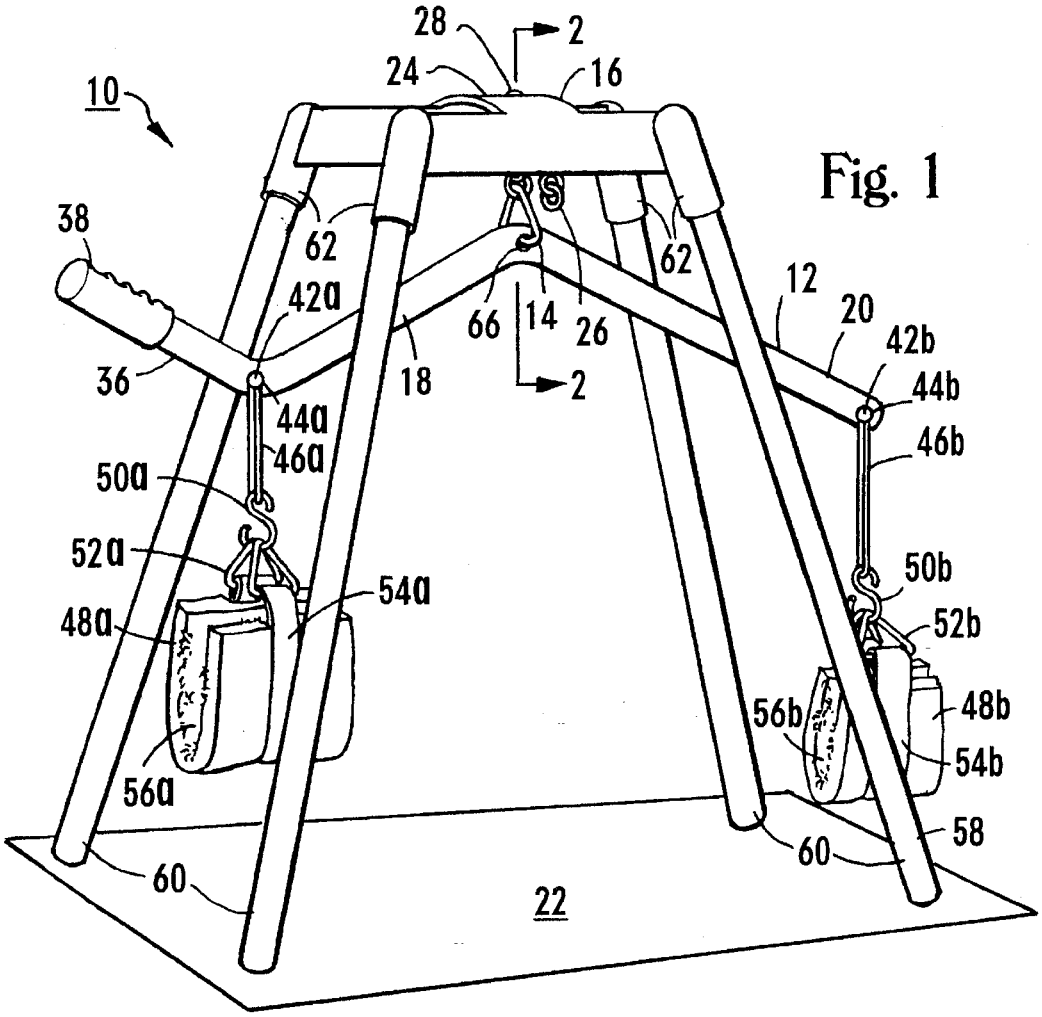
FIG. 1 is a perspective view of a leg suspension device of the present invention.

Referring initially to FIG. 1, a leg suspension device of the present invention is shown and generally designated 10. The leg suspension device 10 has a rotation bar 12, a fulcrum 14 rotatably engaging the rotation bar 12, and a mounting assembly 16 engaging the fulcrum 14. The rotation bar 12, fulcrum 14, and mounting assembly 16 are preferably fabricated from a high-strength, lightweight, rigid material, such as a metal or plastic. The rotation bar 12 has a tubular construction with a proximal segment 18 and a distal segment 20. The terms "proximal" and "distal" are used herein with reference to the upper body of a user properly positioned on a surface 22 supporting the user during operation for the leg suspension device 10.

Figure 2:
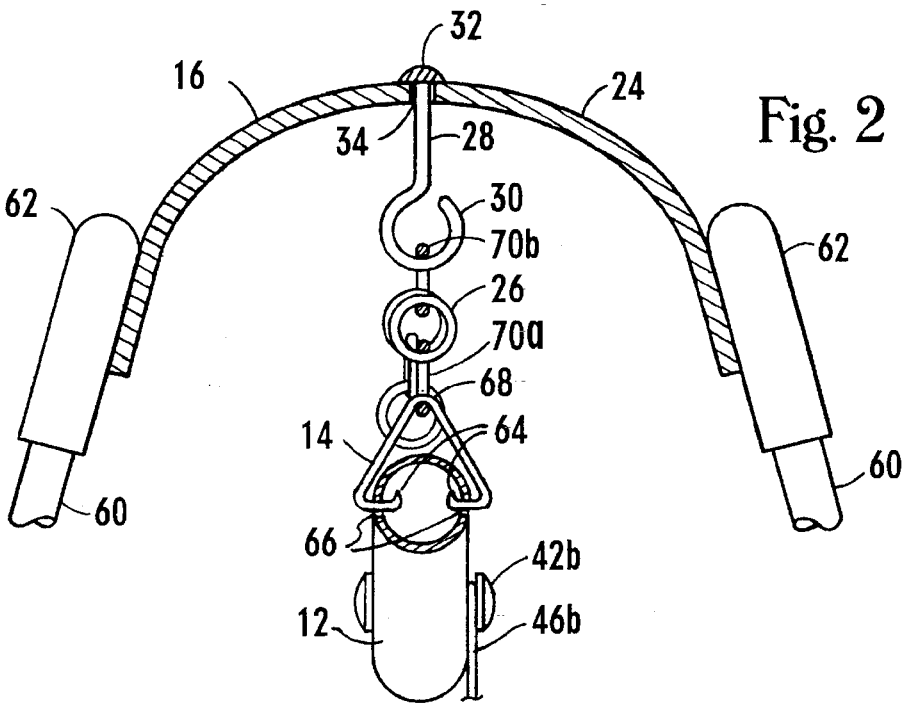
FIG. 2 is a cross-sectional view of the leg suspension device of FIG. 1 as seen along line 2—2.

Referring to both FIGS. 1 and 2, the mounting assembly 16 is shown to comprise a mounting band 24, a connector 26 and a connector retention member 28. The connector 26 of the present embodiment is a flexible chain and the retention member 28 is an eyebolt attached to the mounting band 24. The eye 30 of the eyebolt 28 is positioned on the bottom side of the mounting band 24 and the flattened head 32 of the eyebolt 28 is positioned on the top side of the mounting band 24 with the elongated body of the eyebolt 28 extending through an aperture 34 in the mounting band 24. The fulcrum 14 is a rotation pin rotatably engaging the rotation bar 12 between the proximal and distal segments 18, 20 thereof, and functioning as a pivot to enable rotation of the rotation bar 12 about the fulcrum 14 in a substantially vertical plane relative to the support surface 22, as is described in greater detail hereafter. The connector 26 flexibly suspends the fulcrum 14 from the retention member 28 and mounting band 24.

The rotation bar 12 has a concave profile relative to the support surface 22 with a bend or significant curvature between the proximal and distal segments 18, 20. The rotation bar 12 is provided with a handle 36 extending from the proximal segment 18 that is substantially straight or slightly convex relative to the remainder of the rotation bar 12, thereby facilitating the ergonomic utility of the rotation bar 12. The handle 36 is provided with a hand grip 38 enabling the user to firmly grasp the handle 36 with the hand during specific modes of exercise.

The rotation bar 12 has a proximal retention pin **42*a* affixed to the proximal segment 18 through proximal openings 44*a* formed therein, and further has a distal retention pin 42*b* affixed to the distal segment 20 through distal openings 44*b* formed therein. The proximal retention pin 42*a*, in cooperation with a proximal cord 46*a* suspended therefrom, provides releasable rotatable connection between the rotation bar 12 and an upper leg cuff 48*a* adapted to retain the upper leg of a user. The proximal cord 46*a* is formed from a pliant, yet substantially inelastic material, such as woven nylon fibers, so that the proximal cord 46*a*** does not significantly stretch under the weight of the upper leg.

The upper leg cuff **48*a* is formed in the configuration of a sling from a pliant textile material and is removably connected to the proximal cord 46*a* by means of a rigid metal figure eight loop 50*a* and a pair of rigid metal cuff loops 52*a*. The cuff loops 52*a* are secured to a nylon reinforcement strap 54*a* centrally positioned on the upper leg cuff 48*a*. A fleece cuff cover 56*a* is also provided to conform to and cushion the portion of the user's upper leg that the upper leg cuff 48*a* engages as described hereafter. Although other embodiments of the upper leg cuff 48*a* are not shown, it is apparent that within the scope of the present invention, the upper leg cuff 48*a* can alternatively have a more elongated configuration enabling direct connection of the figure eight loop 50*a* to the proximal retention pin 42*a*, thereby eliminating the proximal cord 46*a***.

A lower leg cuff **48*b* having substantially the same configuration as the upper leg cuff 48*a* is releasably and rotatably connected to the distal segment 20 of the rotation bar 12 in substantially the same manner as the upper leg cuff 48*a* by means of the distal retention pin 42*b* and a distal cord 46*b*. The lower leg cuff 48*b* is similarly provided with a figure eight loop 50*b*, cuff loops 52*b*, a reinforcement strap 54*b*, and a cuff cover 56*b*. In another embodiment not shown, but described above with respect to the upper leg cuff 48*a*, the lower leg cuff 48*b* can be provided with a more elongated configuration enabling direct connection to the distal retention pin 42***b* by means of the figure eight loop 50*b*, thereby eliminating the distal cord 46*b*.

The leg suspension device 10 further comprises means engaging the mounting assembly 16 for elevating the fulcrum 14 to an operative position above the substantially horizontal support surface 22 on which the user reclines to perform the knee or hip flexion and extension exercises enabled by the device 10. The fulcrum elevating means of the present embodiment is a base 58 that is removable and disassemblable rendering the device 10 free-standing for operation, yet fully portable and compact for transport or storage. The base 58 has a plurality of rigid tubular legs 60, each of which is press fittingly received and removably retained within a base receptor socket 62 integral with the fulcrum mounting assembly 16.

Referring specifically to FIG. 2, the cooperative relation between the rotation bar 12, fulcrum 14, and mounting assembly 16 is shown in greater detail. The fulcrum or rotation pin 14 has a v-shaped configuration with hooked ends 64 that are retained within openings 66 on opposite sides of the rotation bar 12, thereby providing a pivot about which the bar 12 is rotatable in a vertical plane. The connector 26 engages the rotation pin 14 at the apex 68 of the rotation pin 14 by looping a selected engagement link 70*a* of the connector 26 through the rotation pin 14. The connector 26 similarly engages the connector retention member 28 by looping another selected engagement link 70*b* of the connector 26 through the eye 30.

The height of the fulcrum 14 above the support surface 22 is adjustable for different size users by selectively changing the engagement link 70*a* that is looped through the eye 30, or alternatively changing the engagement link 70*b* that is looped through the rotation pin 14, in a manner apparent to the skilled artisan. Changing the engagement link selectively lengthens or shortens the distance between the eye 30 and the apex 68, correspondingly lowering or raising the height of the fulcrum 14, respectively. An intermediate height is shown in FIGS. 1 and 2.

The distal retention pin 42*b* is a rivet extending through the rotation bar 12. The length of the distal retention pin 42*b* is substantially longer than the diameter of the rotation bar 12 to provide a length of distal retention pin protruding out of the rotation bar 12 from which the distal cord 46*b* is suspended. Although not shown in FIG. 2, it is understood that the proximal retention pin 42*a* has substantially the same configuration as the distal retention pin 42*b* and bears a similar relation to the rotation bar 12 for suspension of the proximal cord 46*a* therefrom.

Figure 3:
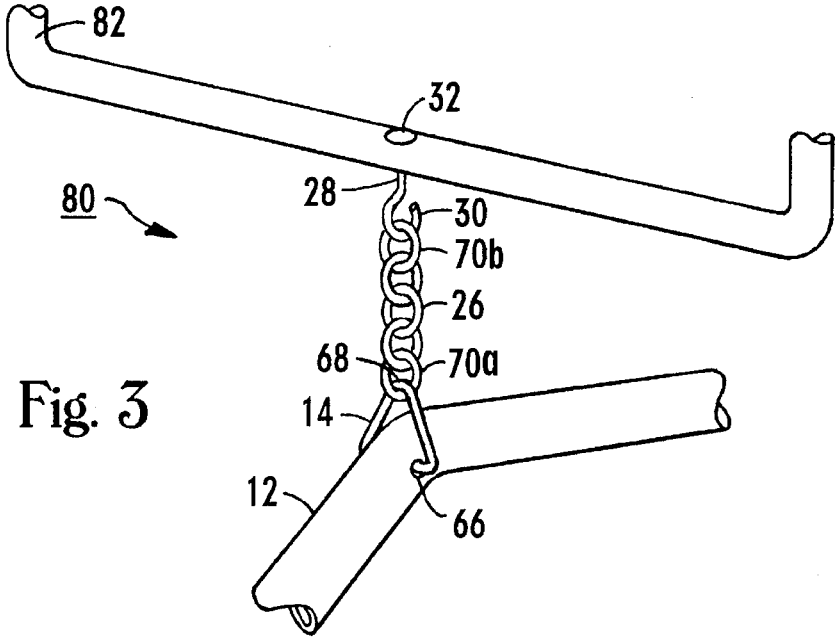
FIG. 3 is a perspective view of an alternate embodiment of the fulcrum elevating means for the leg suspension device of FIG. 1.

FIG. 3 shows an alternate embodiment for a fulcrum elevating means of a leg suspension device of the present invention, wherein the leg suspension device is generally designated 80. The leg suspension device 80 has several elements corresponding to those of the leg suspension device 10, and such corresponding elements are designated by the same reference numbers as used in FIG. 1. Accordingly, the leg suspension device 80 has a rotation bar 12, a fulcrum 14, a connector 26, and a connector retention member 28 in the form of an eyebolt. Although not shown, the leg suspension device 80 is also provided with proximal and distal cords, as well as upper and lower leg cuffs, all configured in substantially the same manner as those of the leg suspension device 10. The mounting band and free-standing base of the leg suspension device 10, however, are eliminated from the leg suspension device 80. Instead, the eyebolt 28 directly engages an overhead anchor 82, such as an elevated frame structure conventionally positioned above a hospital bed, thereby maintaining the fulcrum 14 in an operative position above the support surface without the free-standing base.

It is also noted in FIG. 3 that the connector 26 is fully extended, in contrast to FIGS. 1 and 2, wherein the connector 26 is intermediately extended. The fully-extended connector 26 positions the fulcrum 14 of the leg suspension device 80 at the lowest available height above a support surface. It is apparent, however, that the present connector 26 can be replaced with an even longer chain to enable still lower heights for the fulcrum 14.

Figure 4:
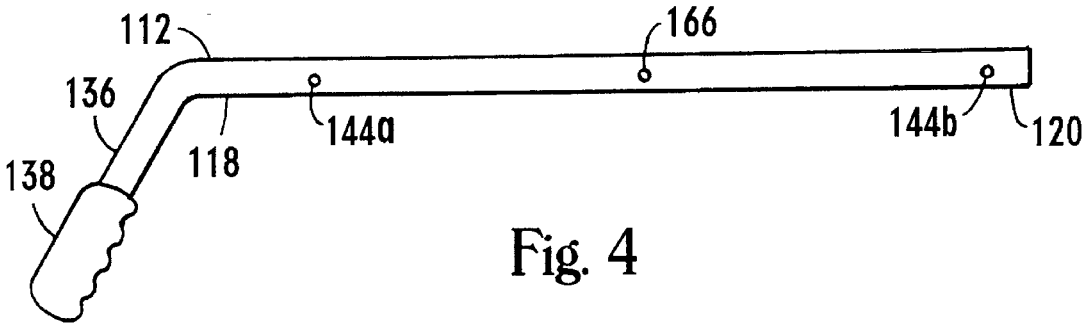
FIG. 4 is an elevational view of an alternate embodiment of the rotation bar for a leg suspension device of the present invention.

FIG. 4 shows an alternate embodiment of a rotation bar having utility with leg suspension devices of the present invention, wherein the rotation bar is designated 112 and has a reconfigured profile as compared to the rotation bar 12 described above. The rotation bar 112 is substantially straight between the proximal and distal segments 118, 120, but has a handle 136 extending from the proximal segment 118 that is ergonomically curved downward in the direction of the support surface 22. The handle 136 is provided with a hand grip 138 similar to that of rotation bar 12. Like rotation bar 12, rotation bar 112 also has an opening 166 formed therethrough between the proximal and distal segments 118,120 to receive the rotation pin (not shown), as well as having proximal and distal openings 144*a*, 144*b* formed in the proximal and distal segments 118,120 to receive the proximal and distal retention pins (not shown), respectively.

Figure 5A:
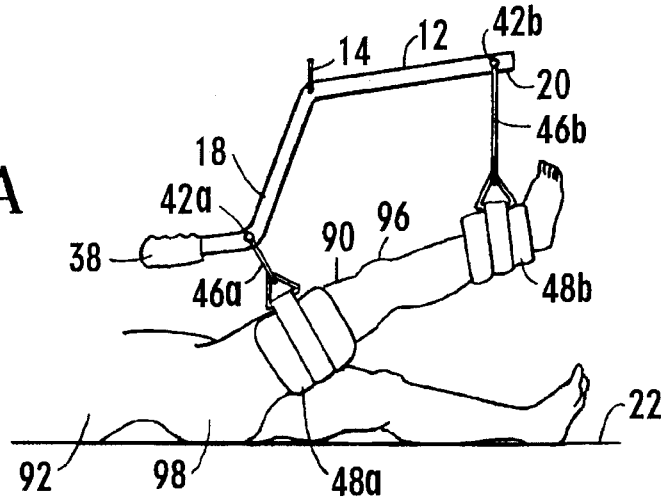
FIG. 5A is an elevational view of the leg suspension device as shown in FIG. 1 having a user engaged in the active motion mode of exercise with the leg in full extension.
Figure 5B:
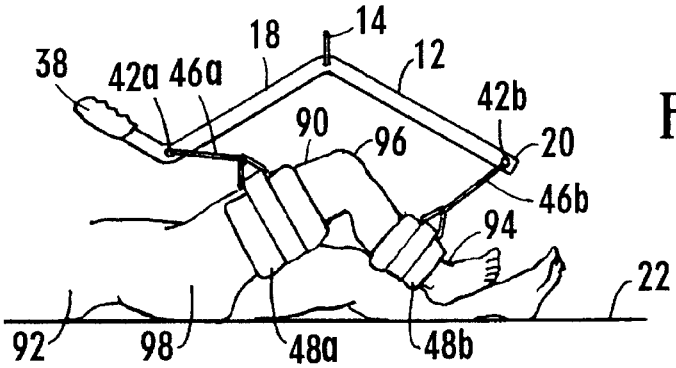
FIG. 5B is an elevational view of the leg suspension device as shown in FIG. 1 having a user engaged in the active motion mode of exercise with the leg in flexion.

Operation of the leg suspension device 10 shown in FIGS. 1 and 2 is described hereafter with reference to FIGS. 5A and 5B, although the fulcrum elevating means is omitted from FIGS. 5A and 5B for clarity of illustration only. It is understood that operation of the alternate leg suspension device 80 shown in FIG. 3 is substantially identical to that of the leg suspension device 10, although the leg suspension device 10 is free-standing on a support surface, rather than secured to an overhead anchor as is the leg support device 80.

The independent active motion mode of exercise shown in FIGS. 5A and 5B is initiated by wrapping the upper leg cuff 48*a* around the thigh 90 of the user 92 while the user 92 is reclining on the support surface 22. The upper leg cuff 48*a* is subsequently rotatably connected to the proximal segment 18 of the rotation bar 12 by means of the proximal retention pin 42*a* and the proximal cord 46*a*. The lower leg cuff 48*b* is similarly wrapped around the ankle 94 of the user 92 and rotatably connected to the distal segment 20. The user 92 then alternately extends and flexes the knee and hip joints 96, 98 solely under the drive of the user's leg muscles as shown in FIGS. 5A and 5B, respectively, to exercise the knee and hip joints 96, 98. It is apparent from FIG. 5A that extension is achieved by driving the upper leg cuff 48*a* downward with the thigh 90, thereby rotating the proximal segment 18 of the rotation bar 12 counterclockwise (substantially downward) about the fulcrum 14. The distal segment 20 of the rotation bar 12 is correspondingly rotated counterclockwise (substantially upward) about the fulcrum 14, drawing the lower leg cuff 48*b* and ankle 94 upward to extend the knee and hip joints 96, 98. In contrast, flexion shown in FIG. 5B is achieved by driving the lower leg cuff 48*b* downward with the ankle 94, thereby rotating the distal segment 20 of the rotation bar 12 clockwise (substantially downward) about the fulcrum 14. The proximal segment 18 of the rotation bar 12 is correspondingly rotated clockwise (substantially upward) about the fulcrum 14, drawing the upper leg cuff 48*a* and thigh 90 upward to flex the knee and hip joints 96, 98.

Although not shown, the passive motion and assisted active motion modes of exercise are substantially the same as the independent active motion mode of exercise shown in FIGS. 5A and 5B. In the passive and assisted active motion modes of exercise, however, the user grasps the grip 38 with the hand, alternately raising and lowering the grip 38, to manually drive flexion and extension exercise of the knee and hip joints 96, 98 employing the mechanics described above. In the passive motion mode of exercise, the user relies solely on the manual drive of the upper body muscles to perform flexion and extension exercise, while in the assisted active motion mode of exercise, the user augments the manual drive of the upper body muscles with the drive of the leg muscles.

Figure 6:
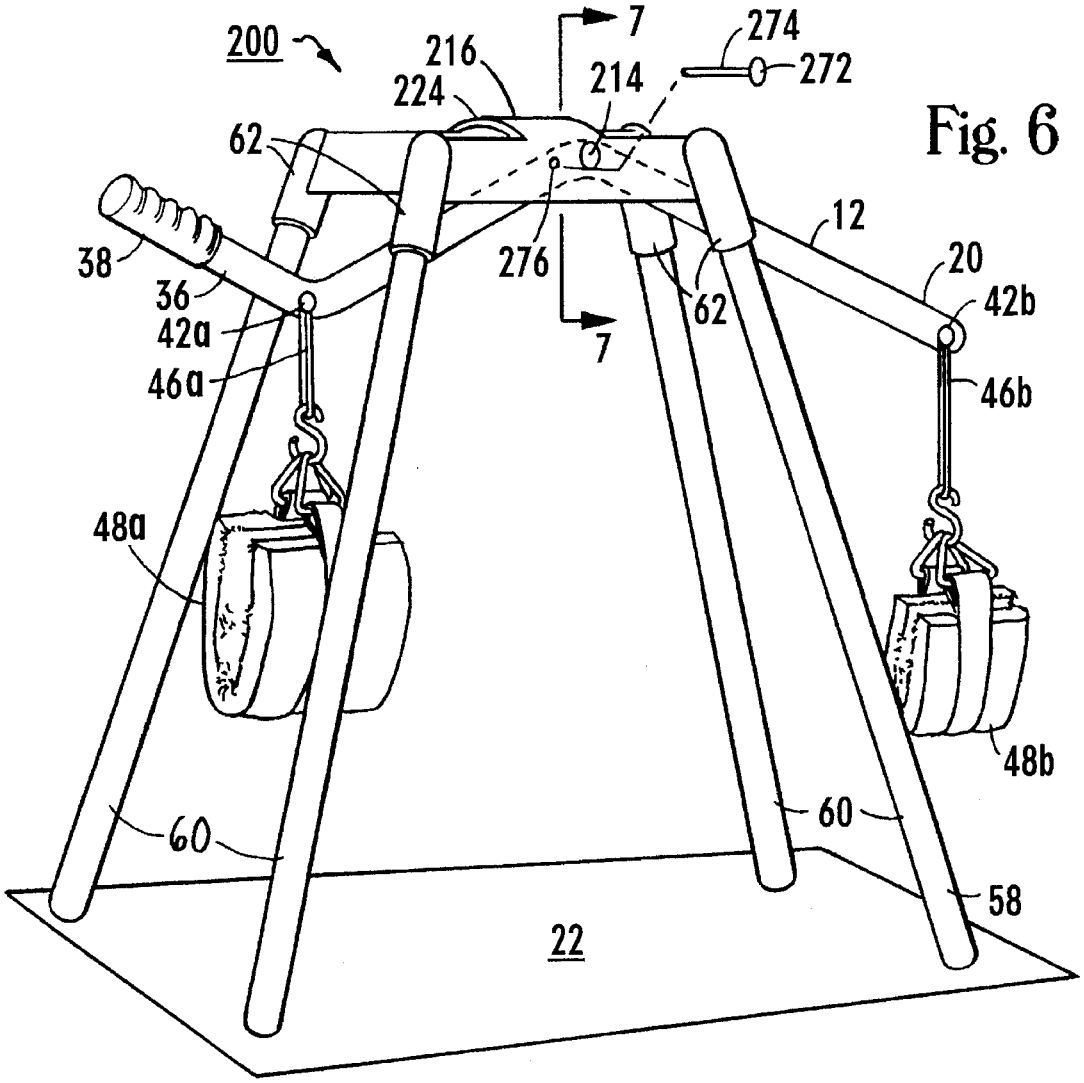
FIG. 6 is a perspective view of a leg suspension device of the present invention having an alternate embodiment of the fulcrum and mounting assembly.
Figure 7:
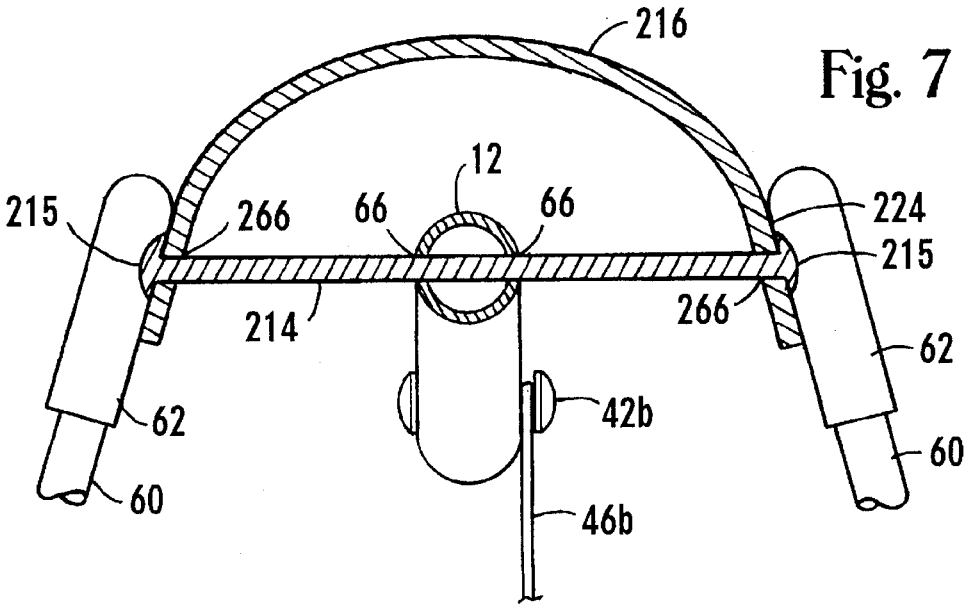
FIG. 7 is a cross-sectional view of the leg suspension device of FIG. 6 as seen along line 2—2.

Referring to FIGS. 6 and 7, another embodiment of the leg suspension device of the present invention is shown and generally designated 200. The leg suspension device 200 is substantially similar to the leg suspension device 10 of FIGS. 1 and 2, except that the leg suspension device 200 has an alternate fulcrum 214 and mounting assembly 216 configuration. The mounting assembly 216, includes a mounting band 224 and a selectively engagable rotation locking mechanism 272. The remaining elements of the leg suspension device 200 corresponding to those of the leg suspension device 10 are designated by the same reference numbers as used in FIG. 1. Accordingly, the leg suspension device 200 has a rotation bar 12 and upper and lower leg cuffs 48*a*, 48*b* rotatably connected thereto by means of proximal and distal retention pins 42*a*, 42*b* and proximal and distal cords 46*a*, 46*b*, respectively. The leg suspension device 200 is further provided with a base 58 having a plurality of legs 60 press fittingly received within base receptor sockets 62 integral with the mounting assembly 216.

Unlike the mounting band 24 of the leg suspension device 10, the mounting band 224 of the present leg suspension device 200 directly engages and retains the fulcrum 214 without the use of a flexible connector. The fulcrum 214 is a relatively straight rotation pin having a substantially horizontal orientation relative to the support surface. The fulcrum 214 extends through apertures 266 formed in the mounting band 224, as well as through the openings 66 formed in the rotation bar 12. Flattened heads 215 on opposite ends of the fulcrum or rotation pin 214 retain the fulcrum 214 in engagement with the mounting band 224.

The rotation bar 12, fulcrum 214 and mounting assembly 216 are cooperatively configured so that the fulcrum 214 engages both the mounting band 224 and the rotation bar 12 simultaneously. The fulcrum 214 engages the rotation bar 12 between the proximal and distal segments 18, 20 thereof, functioning as a pivot to enable rotation of the rotation bar 12 about the fulcrum 214 in a substantially vertical plane relative to the support surface 22. The mounting assembly 216 of the present leg suspension device 200 is further provided with a rotation locking mechanism that can be substantially any conventional means for limiting vertical rotation of the rotation bar 12 about the fulcrum 214. The rotation locking mechanism 272 shown herein is a locking pin 274 slidably insertable into horizontally aligned locking apertures 276 formed through the mounting band 224 to block the clockwise vertical rotation of the rotation bar 12 past the apertures 276 when the locking pin 274 is inserted therein.

Figure 8:
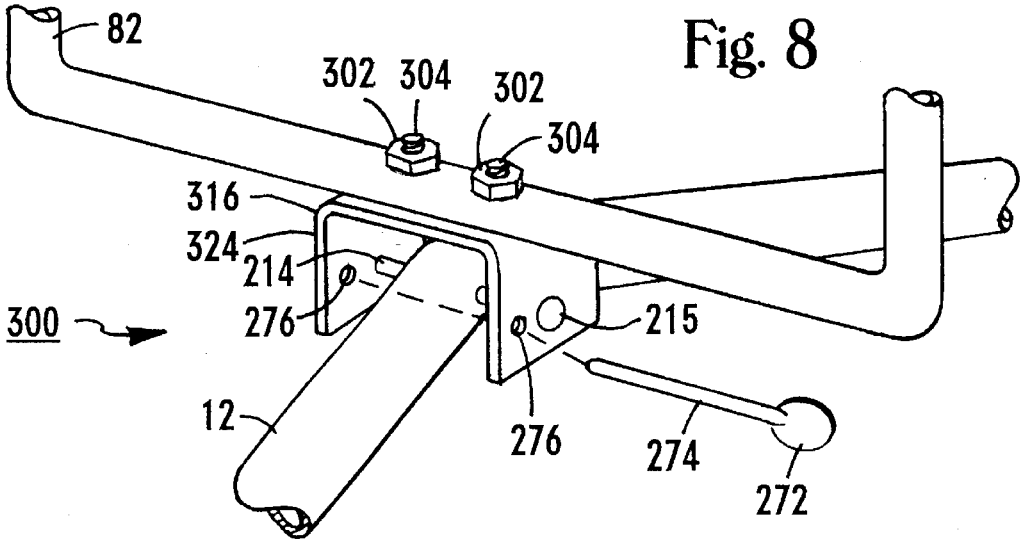
FIG. 8 is a perspective view of an alternate embodiment of the fulcrum elevating means for the leg suspension device of FIG. 6.

FIG. 8 shows yet another embodiment for a fulcrum elevating means of a leg suspension device of the present invention, wherein the leg suspension device is generally designated 300. The leg suspension device 300 has numerous elements corresponding to those of the leg suspension device 200, and such corresponding elements are designated by the same reference numbers as used in FIG. 7. The leg suspension device 300 has a rotation bar 12, a fulcrum 214, and a mounting assembly 316. Although not shown, the leg suspension device 300 is also provided with proximal and distal cords, as well as upper and lower leg cuffs, all configured in substantially the same manner as those of the leg suspension device 200. The free-standing base of the leg suspension device 200 is eliminated from the leg suspension device 300. Instead, the mounting band 324 of the leg suspension device 300 is adapted to directly engage an overhead anchor 82, such as the overhead frame structure of a conventional hospital bed, thereby maintaining the fulcrum 214 in an operative position above the support surface without the base. Engagement of the mounting band 324 to the overhead anchor 82 is provided by a pair of nut and bolt fasteners 302,304, respectively.

Figure 9:
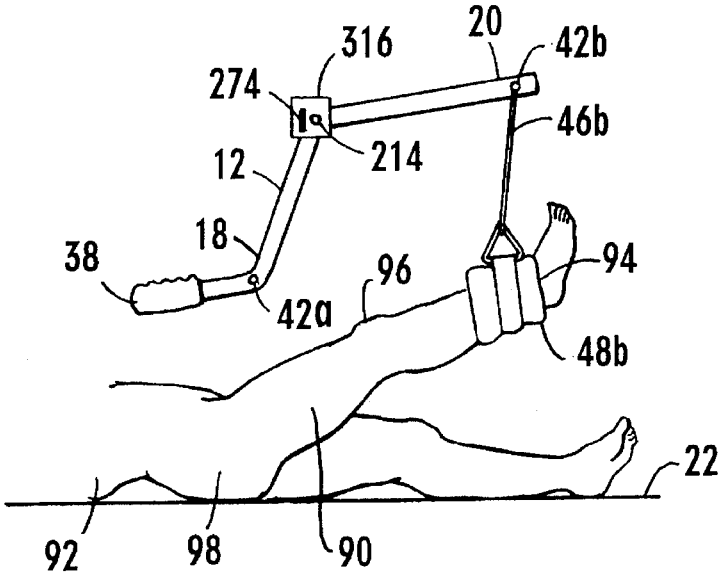
FIG. 9 is an elevational view of the leg suspension device as shown in FIG. 6 having a user engaged in the passive suspension mode of exercise.

The leg suspension devices 200 and 300 are capable of substantially the same dynamic modes of flexion and extension exercises of the knee and hip joint as shown in FIGS. 5A and 5B and described above with respect to the leg suspension devices 10 and 80. The leg suspension devices 200 and 300 are also capable, however, of a static passive suspension mode of exercise as shown in FIG. 9. It is noted that the fulcrum elevating means is omitted from FIG. 9 for clarity of illustration only. The passive suspension mode of exercise is initiated by inserting the locking pin 274 into the locking apertures 276 with the proximal end 18 of the rotation bar 12 positioned beneath it to restrict clockwise rotation of the rotation bar 12. The lower leg cuff 48*b* is then wrapped around the ankle 94 of the user 92 while the user 92 is in a reclining position on the support surface 22. The lower leg cuff 48*b* is connected to the distal segment 20 by means of the distal retention pin 42*b* and the distal cord 46*b*. Meanwhile, the thigh 90 is permitted to hang free of the upper leg cuff. The locking pin 274 maintains the distal segment 20 of the rotation bar 12 in a raised position, correspondingly maintaining the knee joint 96 in a position of full extension. The leg is suspended in this position as long as needed to adequately exert the knee and hip joints 96, 98.

The dynamic modes of exercise are resumed by removing the locking pin 274 from the apertures 276. The upper leg cuff 48*a* is then wrapped around the thigh 90 of the user 92 and connected to the proximal segment 18 of the rotation bar 12 by means of the proximal retention pin 42*a* and the proximal cord 46*a*, while the ankle 94 is retained in the lower leg cuff 48*b* that is connected to the distal segment 20.

While the forgoing preferred embodiments of the invention have been described and shown, it is understood that alternatives and modifications, such as those suggested and others, may be made thereto and fall within the scope of the invention.

We claim:

1. A method for performing flexion and extension exercise on a leg of a subject comprising:

positioning a subject having a leg to be exercised on a support surface, the leg including an upper leg, a lower leg, a knee joint, and a hip joint;

mounting a bar above the leg, said bar having a longitudinal axis, a proximal segment, and a distal segment;

rotatably engaging said bar with a fulcrum positioned between said proximal and distal segments;

suspending the upper leg from said proximal segment of said bar;

suspending the lower leg from said distal segment of said bar; and driving said bar about said fulcrum in a first direction of rotation within a substantially vertical plane to lower the upper leg and raise the lower leg, the knee joint thereby attaining an extension position;

driving said bar about said fulcrum in a second direction of rotation opposite said first direction of rotation to raise the upper leg and lower the lower leg, the knee joint thereby attaining a flexion position.

2. A leg exercise method as recited in claim 1 wherein said longitudinal axis of said bar is substantially aligned with the longitudinal axis of the leg.

3. A leg exercise method as recited in claim 1 wherein the subject engages said proximal segment with a hand and manually drives said bar about said fulcrum with the hand.

* * * * *